US009138993B2

(12) United States Patent
Ooike et al.

(10) Patent No.: US 9,138,993 B2
(45) Date of Patent: Sep. 22, 2015

(54) METHOD OF INK APPLICATION ON SUBSTRATE

(71) Applicant: MURATA MANUFACTURING CO., LTD., Kyoto (JP)

(72) Inventors: Makoto Ooike, Kyoto (JP); Ryoichi Kawagoe, Kyoto (JP); Kensaku Kawamoto, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/940,634

(22) Filed: Jul. 12, 2013

(65) Prior Publication Data

US 2014/0015886 A1 Jan. 16, 2014

(30) Foreign Application Priority Data

Jul. 13, 2012 (JP) ..... 2012-157881

(51) Int. Cl.
*B41J 2/125* (2006.01)
*B41J 3/28* (2006.01)
*B41J 3/407* (2006.01)

(52) U.S. Cl.
CPC .. *B41J 2/125* (2013.01); *B41J 3/28* (2013.01); *B41J 3/407* (2013.01)

(58) Field of Classification Search
CPC ..... B41J 2/125; B41J 2/0458; B41J 2/04563; B41J 29/393; B41J 2/04591; B41J 2/04581
See application file for complete search history.

(56) References Cited

U.S. PATENT DOCUMENTS

2007/0227019 A1* 10/2007 Holzapfel et al. ..... 33/320
2010/0253727 A1* 10/2010 Nishioka et al. ..... 347/14
2012/0147074 A1* 6/2012 Ikeda et al. ..... 347/8

FOREIGN PATENT DOCUMENTS

JP H09-94500 A 4/1997
JP 2000-117171 A 4/2000
JP 2007-130605 A 5/2007
JP 2010-015052 A 1/2010
JP 2010-017683 A 1/2010
JP 2011-131156 A 7/2011

OTHER PUBLICATIONS

English machine translation of JP 2011-131156, accessed online from the AIPN website and attached as PDF.*

(Continued)

*Primary Examiner* — Manish S Shah
*Assistant Examiner* — Jeremy Delozier
(74) *Attorney, Agent, or Firm* — Studebaker & Brackett PC

(57) ABSTRACT

A method of ink application on a substrate having a plurality of reference marks includes a step of setting a plurality of divided areas on the substrate and measuring positions of the reference marks in each of the divided areas, a step of acquiring a deviation amount of a gravity center of a measured figure defined by the positions of the reference marks, a step of acquiring a corrected applied position by correcting a designed applied position on the basis of the deviation amount of the gravity center, and a step of applying ink onto the substrate according to the corrected applied position.

8 Claims, 10 Drawing Sheets

(56) References Cited

OTHER PUBLICATIONS

English machine translation of JP 2010-015052, accessed online from the AIPN website and attached as PDF.*

An Office Action; "Notification of Reasons for Rejection," issued by the Japanese Patent Office on Jun. 17, 2014, which corresponds to Japanese Patent Application No. 2012-157881 and is related to U.S. Appl. No. 13/940,634; with English language translation.

* cited by examiner

METHOD OF INK APPLICATION ON SUBSTRATE

CROSS REFERENCE TO RELATED APPLICATIONS

The present application claims priority to Japanese Patent Application No. 2012-157881 filed on Jul. 13, 2012, the entire contents of this application being incorporated herein by reference in their entirety.

TECHNICAL FIELD

The technical field relates to a method of ink application on a substrate having a plurality of reference marks, and more particularly, to an ink application method using an on-demand printing method.

BACKGROUND

An on-demand printing method forms a conductive pattern, a conductive bump, an insulating resin layer, etc. on a substrate such as a ceramic substrate, a resin substrate, or a semiconductor substrate. In the on-demand printing method, for example, a desired printed figure is formed on the substrate by applying ink from an inkjet head or a dispenser. Since the on-demand printing method performs printing without using a printing plate, the applied position of ink can be changed easily.

Japanese Unexamined Patent Application Publication No. 2011-131156 describes a method for correcting applied positions of ink to be applied onto a substrate by an inkjet printing method. In this method, as illustrated in FIG. 10, a substrate 103 is virtually divided into areas 106 on the basis of measuring points (corners C) provided on the substrate 103, and the deviation amount is found by measuring the positions of the divided areas 106 to correct original applied positions.

SUMMARY

The present disclosure provides a method for applying ink to a desired position on a substrate by an on-demand printing method after an applied position of the ink is properly corrected using a plurality of reference marks provided on the substrate.

The present disclosure is directed to a method of ink application on a substrate having a plurality of reference marks, and can adopt the following first and second preferred embodiments.

In one aspect of the present disclosure, a method of ink application on a substrate according to the first preferred embodiment includes a reference-mark measuring step of setting a plurality of divided areas on a substrate by virtually dividing the substrate along a plurality of virtual lines connecting a plurality of reference marks and measuring positions of the plurality of reference marks in each of the divided areas, a gravity-center deviation-amount acquisition step of acquiring a deviation amount between a gravity center of a measured figure defined by the positions of the plurality of reference marks obtained in the reference-mark measuring step and a gravity center of a designed figure defined by positions of a plurality of designed reference marks by comparing the gravity center of the measured figure and the gravity center of the designed figure, an applied-position acquisition step of acquiring a corrected applied position by shifting and correcting a designed applied position on the basis of the deviation amount between the gravity centers, and an ink application step of applying ink onto the substrate by an on-demand printing method according to the corrected applied position.

In a more specific embodiment, the applied-position acquisition step may further obtain a change ratio of the measured figure and the designed figure by comparing the measured figure and the designed figure, and shift and correct the designed applied position on the basis of the change ratio.

In another more specific embodiment, the applied-position acquisition step may obtain the change ratio by comparing distances from the plurality of reference marks obtained in the reference-mark measuring step to the gravity center of the measured figure and distances from the plurality of designed reference marks to the gravity center of the designed figure.

In yet another more specific embodiment, the reference-mark measuring step and the ink application step may be performed in a state in which the substrate is heated to the same temperature.

In another aspect of the present disclosure, a method of ink application on a substrate according to a second preferred embodiment includes a first reference-mark measuring step of setting a plurality of divided areas on a substrate by virtually dividing the substrate along a plurality of virtual lines connecting a plurality of reference marks and measuring positions of the plurality of reference marks in each of the divided areas, a tilt-angle acquisition step of acquiring a tilt angle of a tilted figure defined by the positions of the plurality of reference marks obtained in the first reference-mark measuring step by comparing the tilted figure and a designed figure defined by positions of a plurality of designed reference marks, a second reference-mark measuring step of measuring the positions of the plurality of reference marks after correcting a tilt of the tilted figure on the basis of the tilt angle, a gravity-center deviation-amount acquisition step of acquiring a deviation amount between a gravity center of a measured figure defined by the positions of the plurality of reference marks obtained in the second reference-mark measuring step and a gravity center of the designed figure by comparing the gravity center of the measured figure and the gravity center of the designed figure, an applied-position acquisition step of acquiring a corrected applied position by shifting and correcting a designed applied position on the basis of the deviation amount between the gravity centers, and an ink application step of applying ink onto the substrate by an on-demand printing method according to the corrected applied position after the tilt of the tilted figure is corrected on the basis of the tilt angle.

In a more specific embodiment, the applied-position acquisition step may further obtain a change ratio of the measured figure and the designed figure by comparing the measured figure and the designed figure, and shift and correct the designed applied position on the basis of the change ratio.

In another more specific embodiment, the applied-position acquisition step may obtain the change ratio by comparing distances from the plurality of reference marks obtained in the second reference-mark measuring step to the gravity center of the measured figure and distances from the plurality of designed reference marks to the gravity center of the designed figure.

In still another more specific embodiment, the first reference-mark measuring step, the second reference-mark measuring step, and the ink application step may be performed in a state in which the substrate is heated to the same temperature.

Other features, elements, characteristics and advantages will become more apparent from the following detailed description of preferred embodiments with reference to the attached drawings.

BRIEF DESCRIPTION OF THE DRAWINGS

FIG. 5A illustrates deviation between a measured figure and a designed figure, and FIG. 5B illustrates how to correct an applied position in an applied-position acquisition step.

FIG. 6A illustrates how to find a change ratio of the measured figure and the designed figure, and FIG. 6B illustrates how to correct the applied position by reducing the designed figure in a similar form.

FIG. 8A illustrates how to find a tilt angle of a tilted figure, and FIG. 8B illustrates a state after the tilted figure is corrected on the basis of the tilt angle.

DETAILED DESCRIPTION

In the applied-position correcting method described in the above publication, the positions of the corners C of the divided areas 106 are measured, and, with reference to a specific corner C at an end of the substrate 103, the coordinates of the corners C of the other areas 106 are set. In general, the substrate 103 can significantly deform from its original shape. In particular, deformation at the corner C at the end of the substrate 103 is sometimes larger than at the other corners C. The inventors realized that if the applied positions are corrected with reference to the greatly deformed corner C as a coordinate reference, the correction includes a great deviation, and the corrected applied positions are sometimes quite different from the original applied positions. In this case, even when an on-demand printing method is used, it is difficult to change the applied positions according to the deformation state of the substrate 103.

The present disclosure relates to a method of ink application on a substrate having a plurality of reference marks, and adopts a first exemplary embodiment and a second exemplary embodiment corresponding to the first preferred embodiment and the second preferred embodiment described above, respectively. Equipment is commonly used in these embodiments. Accordingly, an on-demand printing apparatus serving as a common apparatus will be described first in conjunction with the first embodiment.

An on-demand printing apparatus forms a desired printed figure on a substrate by applying ink from a print head onto the substrate. An example of an ink application method is an on-demand printing method such as an inkjet printing method or a dispenser method.

Figure 1:
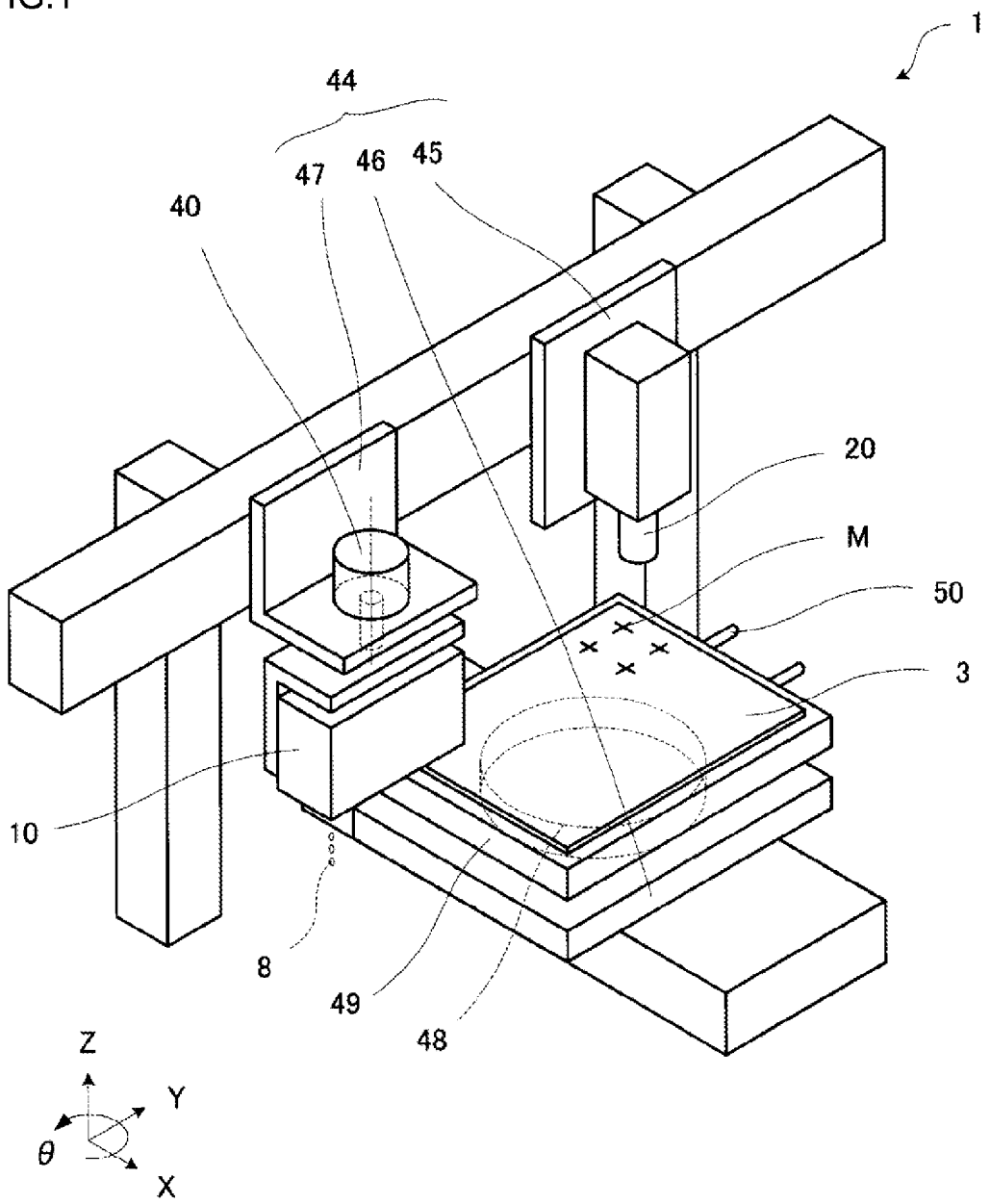
FIG. 1 is a perspective view of an on-demand printing apparatus used in a method of ink application on a substrate according to a first exemplary embodiment.
Figure 2:
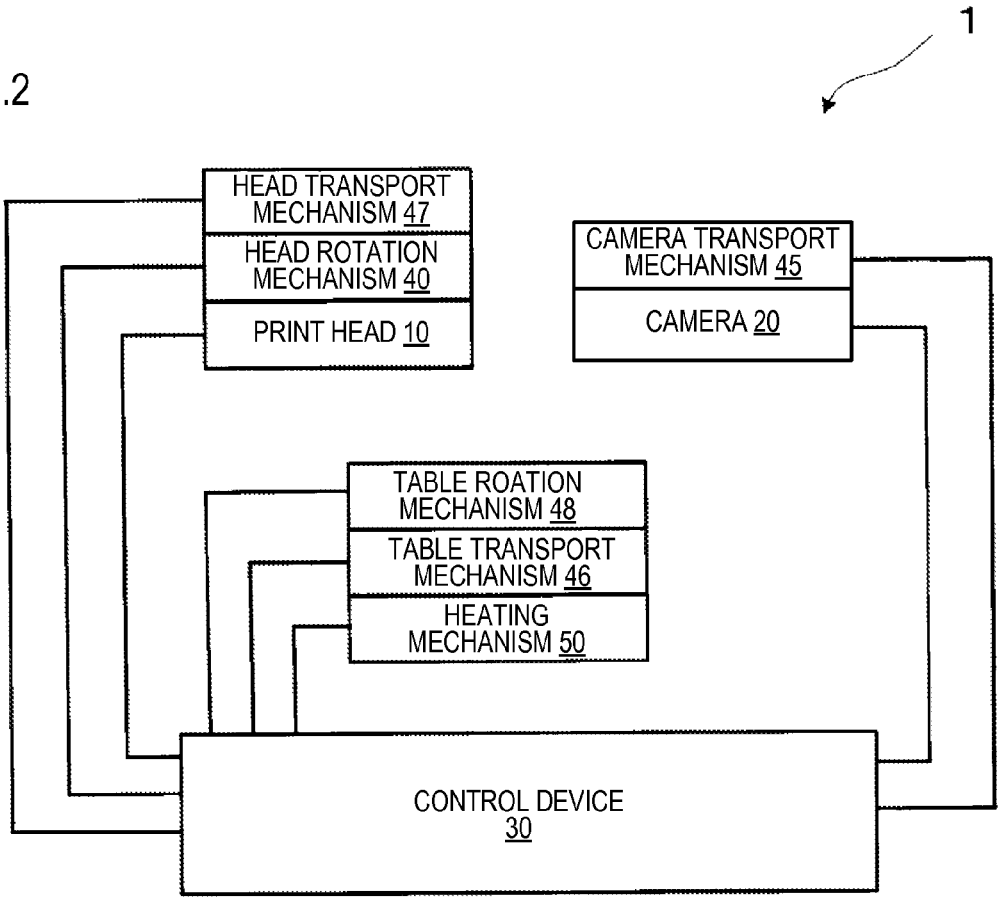
FIG. 2 is a control block diagram of the on-demand printing apparatus illustrated in FIG. 1.

As illustrated in FIGS. 1 and 2, an on-demand printing apparatus 1 includes a camera 20 that measures reference marks M on a substrate 3, a control device 30 that corrects an applied position of ink 8 on the basis of the measured positions of the reference marks M, a print head 10 that applies the ink 8 onto the substrate 3, and a translation mechanism 44 that moves the print head 10 or the camera 20 relative to a principal surface of the substrate 3 in a parallel direction.

In the following, a direction orthogonal to the principal surface of the substrate 3 is referred to as a Z-direction, a predetermined print direction along the principal surface of the substrate 3 is referred to as an X-direction, a direction orthogonal to the Z-direction and the X-direction is referred to as a Y-direction, and a rotation direction along the X-direction and the Y-direction is referred to as a θ-direction.

As illustrated in FIG. 1, the substrate 3 to be printed is placed below the print head 10. Examples of ink 8 to be applied onto the substrate 3 are metal paste, conductive resin paste having conductivity obtained by mixing a conductive filler in insulating resin, conductive polymer paste, and insulating resin paste. By applying the ink 8 onto the substrate 3, for example, a conductive pattern, a conductive bump, or an insulating resin layer is formed on the substrate 3. In the first embodiment, conductive bumps are formed on the substrate 3.

Figure 3A:
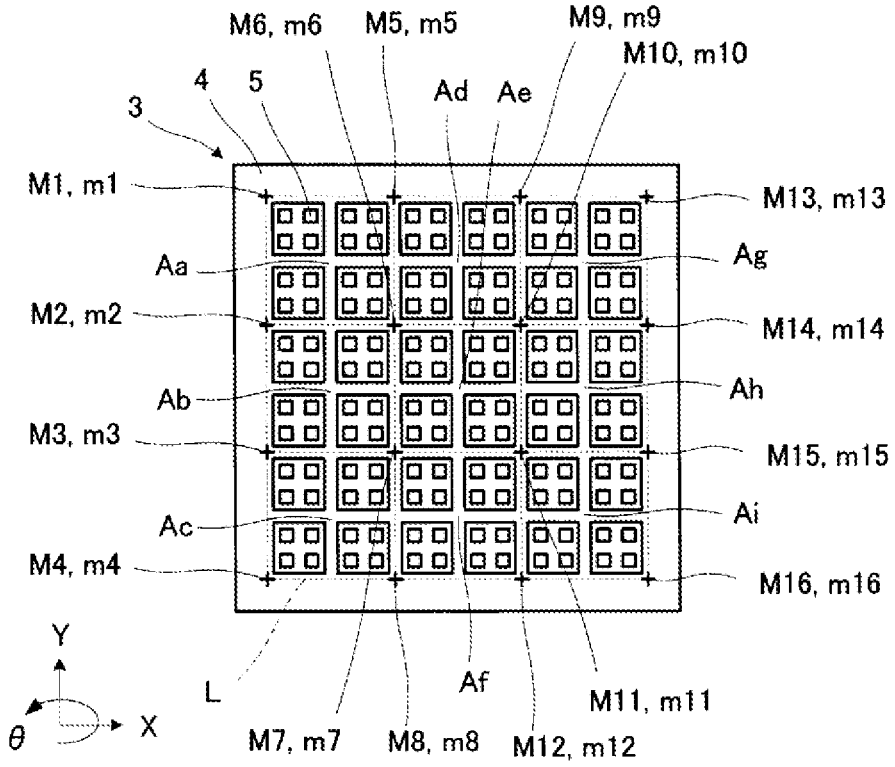
FIG. 3A is a plan view of a substrate before ink is applied thereon.

As illustrated in FIG. 3A, the substrate 3 includes a substrate body 4, inner electrodes (not illustrated) provided in the substrate body 4, outer electrodes 5 connected to the inner electrodes and exposed from a principal surface of the substrate body 4, and reference marks M1 to M16 provided in a matrix on the principal surface of the substrate body 4. For example, the substrate 3 is formed of a ceramic material, resin, or a semiconductor, and the length of one side of the substrate 3 is about 200 mm.

The reference marks M1 to M16 are formed of metal such as Cu or Au. While the reference marks M1 to M16 illustrated in FIG. 3A are substantially cross-shaped, the shape of the reference marks M1 to M16 is not limited thereto, and may be a substantially circular shape or a substantially quadrangular shape, for example. The outer electrodes 5 on the substrate body 4 may be substituted for reference marks as long as they are arranged regularly.

In the following, reference marks actually formed on the substrate 3 are referred to as reference marks M, and originally designed reference marks are referred to as reference marks m. The reference marks M1 to M16 are collectively referred to as reference marks M, and reference marks m1 to m16 are collectively referred to as reference marks m.

In a front end process for obtaining a state illustrated in FIG. 3A, the substrate 3 is subjected to heat treatment, such as firing or thermosetting, after the outer electrodes 5 and the reference marks M are formed on the substrate body 4. The substrate 3 is deformed by the heat treatment. A deformation state is influenced by heat treatment conditions and the shape of the inner electrodes, and frequently differs among areas in the substrate 3. To properly grasp the deformation state of the substrate 3, it is necessary to read the positions of the reference marks M on the substrate 3 and to compare the positions of the reference marks M with the positions of the designed reference marks m.

Figure 3B:
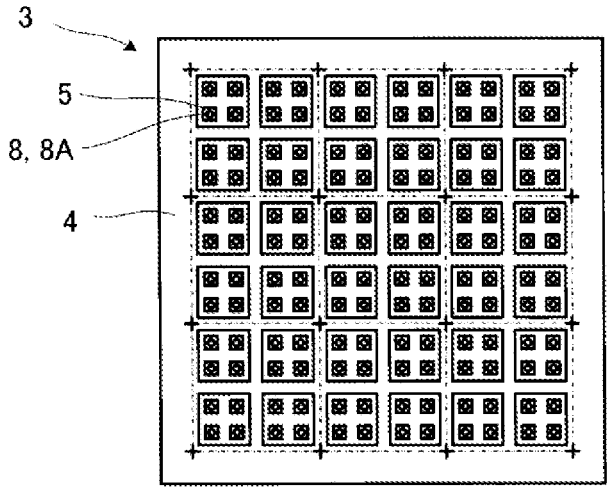
FIG. 3B is a plan view of the substrate after the ink is applied thereon.

FIG. 3B illustrates a state in which the ink 8 is applied on the outer electrodes 5 of the substrate 3 illustrated in FIG. 3A.

By correcting the applied positions of the ink 8 on the basis of the reference marks M on the substrate 3, the ink 8 is applied onto positions adequate for the deformation state of the substrate 3. The applied ink 8 is then subjected to heat treatment such as drying, whereby conductive bumps 8A are formed on the substrate 3.

Figure 3C:
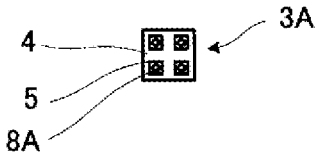
FIG. 3C is a plan view of one individual substrate obtained by singulation of the substrate of FIG. 3B.

FIG. 3C illustrates one individual substrate 3A obtained by singulation of the substrate 3 of FIG. 3B in a back end process. The yield of the individual substrate 3A to the substrate 3 is lowered unless the conductive bumps 8A are formed on proper positions on the individual substrate 3A.

The camera 20 illustrated in FIGS. 1 and 2 takes images of the reference marks M provided on the substrate 3. When a camera transport mechanism 45 or a table transport mechanism 46 is driven, the camera 20 is moved relative to the substrate 3 to sequentially take images of the reference marks M on the substrate 3. Data on the images taken by the camera 20 is transmitted to the control device 30, where the positions of the reference marks M on the substrate 3 are recognized.

The control device 30 receives various signals in the on-demand printing apparatus 1, performs arithmetic processing, and controls outputs to the mechanisms. By arithmetically processing the transmitted image data in the control device 30, the deformation state of the substrate 3 is grasped. On the basis of the deformation state of the substrate 3, the control device 30 subjects the applied positions to corrective operation, and the mechanisms in the on-demand printing apparatus 1 are driven on the basis of the result of corrective operation.

The print head 10 includes an inkjet head (not illustrated), and the inkjet head includes a plurality of nozzles (not illustrated) for discharging the ink 8. In the inkjet head, an ink chamber that stores the ink 8 before discharging and piezoelectric elements (not illustrated) that push out the ink 8 are provided. By driving the piezoelectric elements, the ink 8 in the ink chamber is discharged and applied onto the substrate 3. The ink 8 may be applied by a thermal method instead of the above-described method using the piezoelectric elements.

The translation mechanism 44 includes a table transport mechanism 46 that transports the substrate 3 in the X-direction, a head transport mechanism 47 that transports the print head 10 in the Y-direction, and a camera transport mechanism 45 that transports the camera 20 in the Y-direction. The table transport mechanism 46, the head transport mechanism 47, and the camera transport mechanism 45 can be driven by a single-axis robot as an example. By driving the translation mechanism 44, the print head 10 or the camera 20 is moved relative to the substrate 3 while maintaining a state parallel to the principal surface of the substrate 3.

The above is the main configuration of the on-demand printing apparatus 1. The on-demand printing apparatus 1 can include a head rotation mechanism 40, a heating mechanism 50, or a table rotation mechanism 48 illustrated in FIGS. 1 and 2, as required.

The head rotation mechanism 40 rotates the print head 10 in the θ-direction. By driving the head rotation mechanism 40, the application pitch of the ink 8 from the print head 10 is changed, and the print resolution of the on-demand printing apparatus 1 is changed. This allows the ink 8 is to be more reliably applied according to the deformation state of the substrate 3.

The heating mechanism 50 heats the substrate 3 to a predetermined temperature higher than or equal to the room temperature via a table 49 provided under the substrate 3. To shorten the dry time of the ink 8 landing on the substrate 3, the substrate 3 is preferably heated beforehand by the heating mechanism 50. Although the substrate 3 is thermally expanded by the temperature rise, the ink 8 can be applied to proper positions by correcting the applied positions according to the deformation state of the substrate 3 on the basis of the reference marks M.

The table rotation mechanism 48 corrects the tilt of the substrate 3 in the θ-direction via the table 49, and is provided between the table transport mechanism 46 and the table 49. The table rotation mechanism 48 is driven by a direct drive motor as an example. By driving the table rotation mechanism 48, the applied positions can be corrected according to the tilt of the figure. Correction of the tilt in the θ-direction using the table rotation mechanism 48 will be described with reference to a second embodiment.

Figure 4:
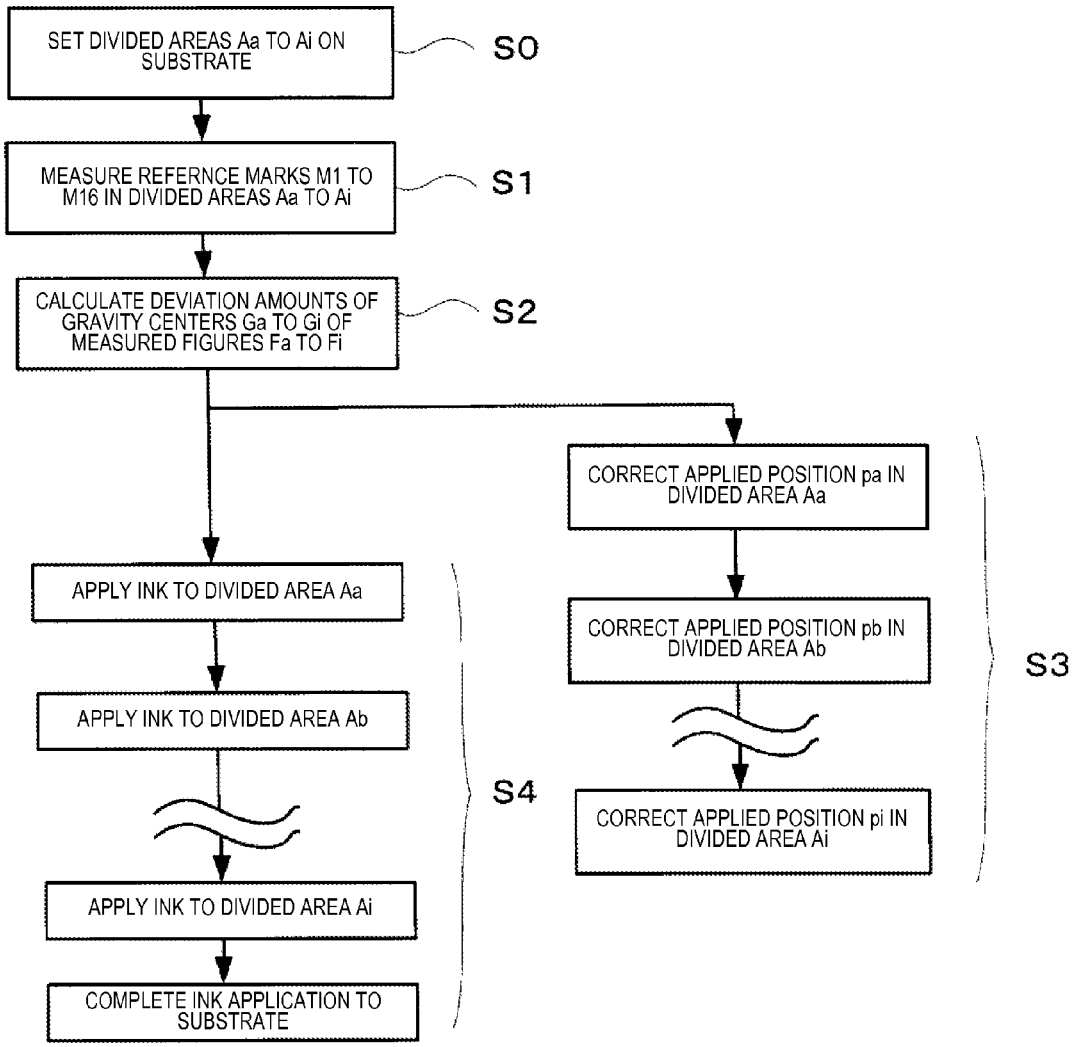
FIG. 4 illustrates a series of steps in the method of ink application on the substrate according to the first embodiment.

A method of ink application on a substrate according to the first embodiment will be described with reference to FIGS. 3A to 6B. As illustrated in FIG. 4, the method of ink application includes a divided-area setting step S0, a reference-mark measuring step S1, a gravity-center deviation-amount acquisition step S2, an applied-position acquisition step S3, and an ink application step S4. These steps will be described in order below.

In the divided-area setting step S0, as illustrated in FIGS. 3A and 3B, a plurality of divided areas Aa to Ai are set on the substrate 3. The divided areas Aa to Ai are set by virtually dividing the substrate 3 along a plurality of virtual lines L connecting a plurality of reference marks m on the substrate 3. The substrate 3 is divided into a plurality of areas to correct applied positions according to deformation states of the divided areas Aa to Ai in the applied-position acquisition step S3 described below. While divided areas A may be set for each substrate 3, they are preferably preset according to the type of the substrate 3 on the basis of design data on the substrate 3.

In the following, areas divided along the virtual lines L are referred to as divided areas Aa to Ai, and the divided areas Aa to Ai are collectively referred to as divided areas A. This also applies to other alphabets used in the first embodiment.

In the reference-mark measuring step S1, the positions of a plurality of reference marks M provided on the substrate 3 are measured in each of the divided areas A. As illustrated in FIG. 1, when the translation mechanism 44 is driven, the camera 20 is placed above the substrate 3 and takes images of the reference marks M. Data on the taken images is transmitted to the control device 30, and is then subjected to arithmetic processing, whereby the positions of the reference marks M are recognized.

In the gravity-center deviation-amount acquisition step S2, the deviation amount of an actual figure from a designed figure is found in each of the divided areas A. As a method for finding the deviation amount, attention is paid to the gravity center of a designed figure and the gravity center of a measured figure. When attention is paid to the gravity centers of the figures, even if a great deformation is caused at the corner of each divided area A, it does not have a serious effect, and an average deformation of the divided areas A can be grasped.

Figure 5A:
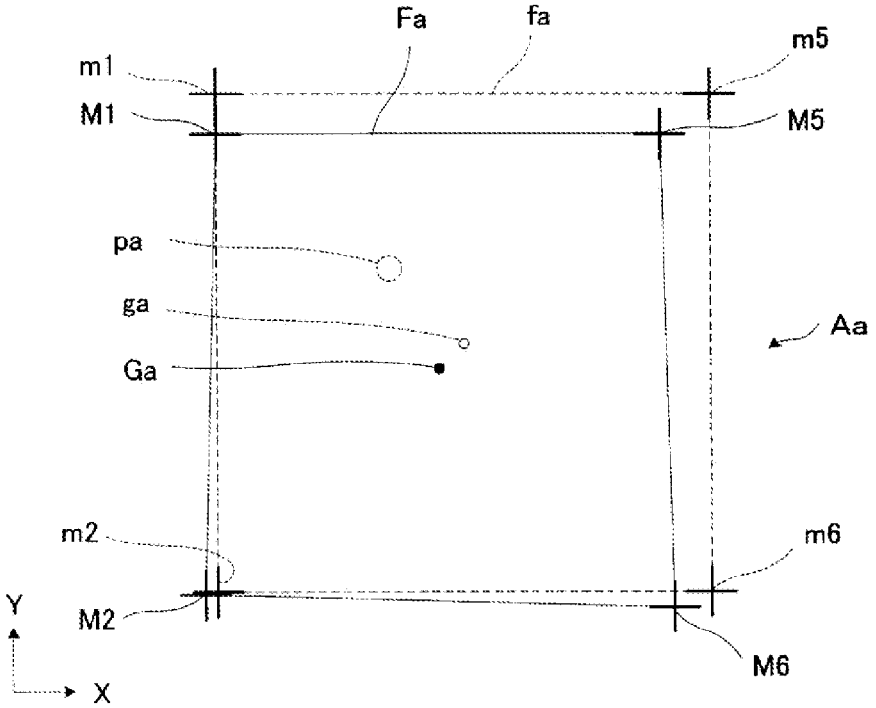
FIGS. 5A and 5B illustrate a divided area on the substrate.
Figure 5B:
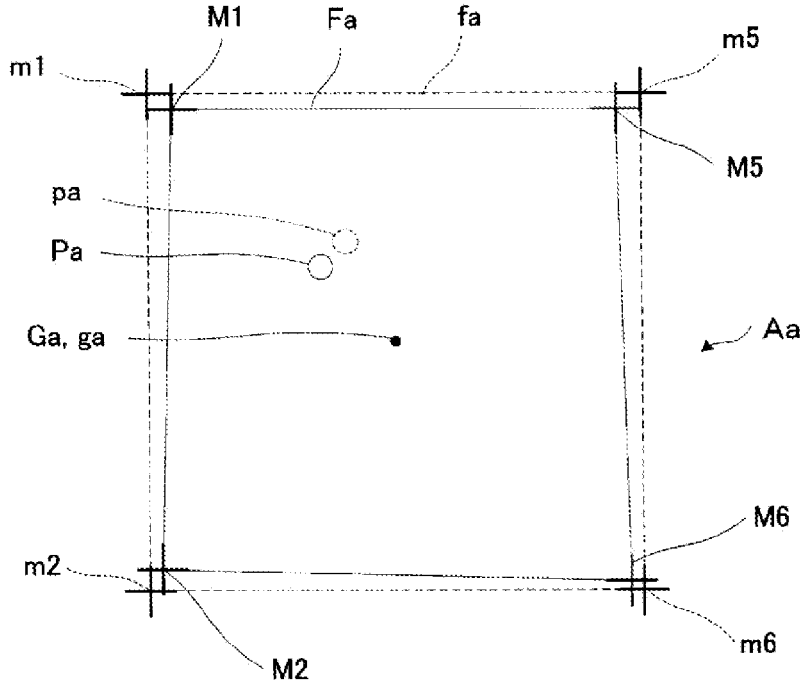

The method for finding the deviation amount of the gravity center will be described below with reference to FIGS. 5A and 5B. FIGS. 5A and 5B illustrate the divided area Aa illustrated in FIG. 3A.

A measured figure F serving as a figure in measurement is defined by the positions of the reference marks M obtained in the reference-mark measuring step S1. More specifically, as illustrated in FIG. 5A, a measured figure Fa is substantially shaped like a quadrangle defined by the reference marks M1, M2, M5, and M6 serving as vertexes. The position of a gravity center Ga of the measured figure Fa is calculated in the control device 30 on the basis of the position coordinates of the reference marks M1, M2, M5, and M6.

A designed figure f serving as a figure in design is defined by the positions of the designed reference marks m. More specifically, as illustrated in FIG. 5A, a designed figure fa is substantially shaped like a quadrangle defined by the reference marks m1, m2, m5, and m6 serving as vertexes. The position of a gravity center ga of the designed figure fa is calculated in the control device 30 on the basis of position coordinates of the reference marks m1, m2, m5, and m6.

The deviation amount of the gravity center in the divided area Aa is obtained by comparing the position coordinates of the gravity center Ga of the measured figure Fa and the position coordinates of the gravity center ga of the designed figure fa. In the other divided areas Ab to Ai, the deviation amounts of gravity centers Gb to Gi of measured figures Fb to Fi from gravity centers gb to gi of designed figures fb to fi are obtained similarly.

In the applied-position acquisition step S3, a corrected applied position P is obtained on the basis of the deviation amount between the measured figure F and the designed figure f in each divided area A.

More specifically, on the basis of the deviation amount between the gravity center Ga of the measured figure Fa and the gravity center ga of the designed figure fa obtained in the gravity-center deviation-amount acquisition step S2, a designed applied position pa is corrected by being shifted in a direction of deviation and by a distance of deviation, whereby a corrected applied position Pa is obtained.

As illustrated in FIG. 5B, the designed figure fa is moved so that the gravity center ga of the designed figure fa coincides with the gravity center Ga of the measured figure Fa, and the designed applied position pa is correspondingly moved. A position to which the applied position pa moves serves as a corrected applied position Pa. This corrective operation based on the deviation is also performed by the control device 30. In the other divided areas Ab to Ai, corrected applied positions Pb to Pi are obtained similarly.

To further increase the positional accuracy of the applied position P, the following correction is performed in each divided area A. In this correction method, in a state in which the gravity center G and the gravity center g coincide with each other, the designed applied position p is further shifted on the basis of a change ratio R of the measured figure F and the designed figure f. According to this method, the scale of the designed figure f is corrected in accordance with the scale of the measured figure F, and this can further increase the positional accuracy of a corrected applied position P'.

Figure 6A:
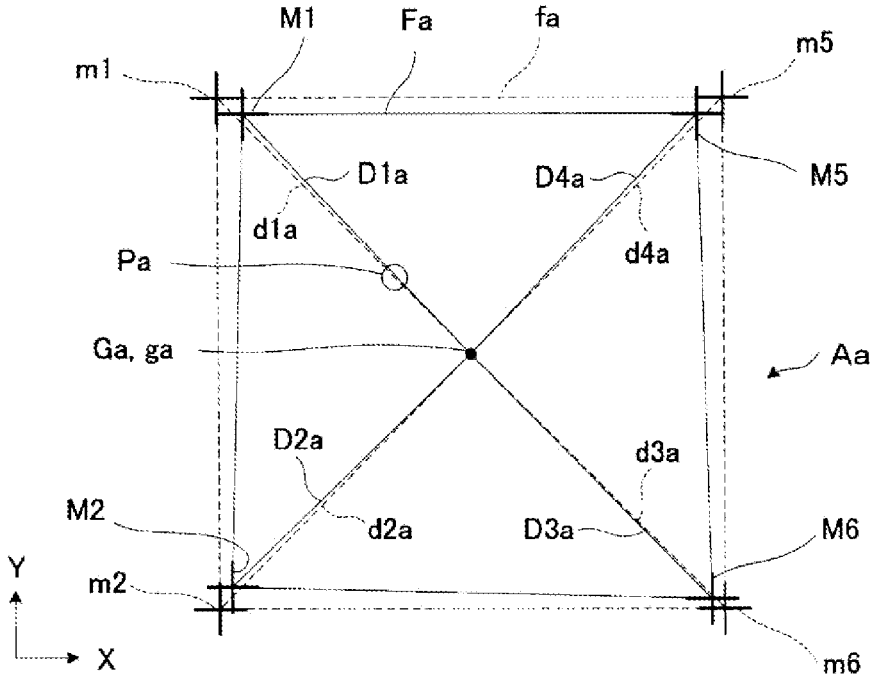
FIGS. 6A and 6B illustrate the divided area of the substrate.
Figure 6B:
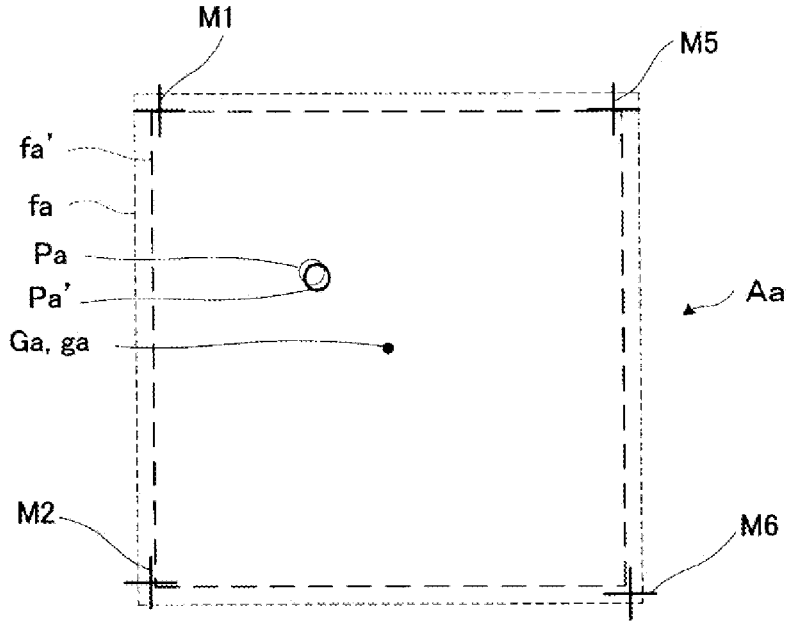

This correction method will be described below with reference to FIGS. 6A and 6B. FIGS. 6A and 6B also illustrate the divided area Aa illustrated in FIG. 3A.

As illustrated in FIG. 6A, first, distances D1*a* to D4*a* from the gravity center Ga of the measured figure Fa to the reference marks M1, M2, M5, and M6 are obtained by coordinate operation. In contrast, distances d1*a* to d4*a* from the gravity center ga of the designed figure fa to the reference marks m1, m2, m5, and m6 are obtained by coordinate operation.

After that, the ratios of the distances from the gravity center G to the reference marks M and the distances from the gravity center g to the reference marks m are obtained, and the ratios are averaged according to Expression 1 to obtain an average value, which serves as a change ratio Ra of the measured figure Fa and the designed figure fa:

$$Ra=\{(D1a/d1a+D2a/d2a+D3a/d3a+D4a/d4a)\}/4 \quad (1).$$

An applied position Pa' is obtained by multiplying the position coordinates of the applied position Pa obtained beforehand (the position coordinates of the applied position Pa based on the gravity center ga) by the change ratio Ra.

As illustrated in FIG. 6B, the designed figure fa is reduced in a similar form with reference to the gravity center ga on the basis of the change ratio Ra, and the position coordinates of the applied position Pa is moved with the reduction. The designed figure fa is reduced to a reduced figure fa', and a position to which the applied position Pa moves serves as a corrected applied position Pa'.

In the other divided areas Ab to Ai, similarly, change ratios Rb to Ri are obtained, and the designed figures fb to fi are reduced or enlarged in a similar form, whereby corrected applied positions Pb' to Pi' are obtained.

While FIGS. 6A and 6B illustrate the process in which the measured figure F is reduced, even when the change ratio Ra is higher than 1 and the measured figure F is enlarged, the applied position P can be similarly corrected by using the method for finding the change ratio R on the basis of the distances d between the gravity center G and the reference marks M.

By using the method for finding the change ratio R on the basis of the distances d between the gravity center G and the reference marks M, correction can be made in correspondence with various designed figures f. For example, the applied position P can be corrected even when the shape of the designed figure f is not only a substantially quadrangular shape such as a substantially rectangular shape, a substantially parallelogrammatic shape, or a substantially trapezoidal shape, but also a substantially polygonal shape such as a substantially hexagonal shape.

While the applied position P is represented by a point in the first embodiment, when a two-dimensional figure is drawn, the applied position P can be corrected while treating vertexes or inflection points of the two-dimensional figure as applied positions P or treating the two-dimensional figure itself as a series of points.

In the ink application step S4, the ink 8 is applied in each divided area A. When the translation mechanism 44 is driven prior to application of the ink 8, the camera 20 located above the substrate 3 is withdrawn, and the print head 10 is placed above the substrate 3. After that, the ink 8 is applied according to the corrected applied position P obtained in the applied-position acquisition step S3.

In actuality, the ink 8 is applied to the applied position P in the divided area A on the substrate 3 by being discharged from the print head 10 while driving the translation mechanism 44. The application pitch of the ink 8 can be easily changed by rotating the print head 10 while driving the table rotation mechanism 48.

In the application procedure for the ink 8, first, application of the ink 8 starts from the divided area Aa. In contrast, as illustrated in FIG. 4, the control device 30 performs operation to correct the applied position pb in the divided area Ab during application of the ink 8. By performing the operation of applying the ink 8 and the operation of correcting the applied position p in parallel, the application operation of the ink 8 can be started without any need to wait for all applied positions p to be subjected to corrective operation. This increases the throughput of a series of steps in the method of ink application on the substrate.

When the application of the ink 8 in the divided area Aa is finished, the ink 8 is similarly applied in the other divided areas Ab to Ai on the basis of the corrected applied positions Pb to Pi. To increase the thickness of a layer of the applied ink 8, the ink 8 is repeatedly applied onto the substrate 3. When the application of the ink 8 in all divided areas A is completed, the operation of applying the ink onto the substrate 3 is finished.

To shorten the dry time of the ink 8 landing on the substrate 3, the substrate 3 can be heated to a predetermined temperature in the ink application step S4. However, the substrate 3 also needs to be heated in the reference-mark measuring step S1 so that the amount of thermal expansion of the substrate 3 is equal between the ink application step S4 and the reference-mark measuring step S1. In this case, the heating temperature for the substrate 3 is preferably equal between the ink application step S4 and the reference-mark measuring step S1.

A second exemplary embodiment of a method of ink application on substrate will now be described.

In the second embodiment, an applied position is corrected after the tilt of a figure in the θ-direction is corrected. In this case, even if the figure is distorted in the θ-direction, ink 8 can be applied to a proper position. Structures common to the first embodiment are denoted by the same reference numerals, and descriptions thereof are skipped.

Figure 7:
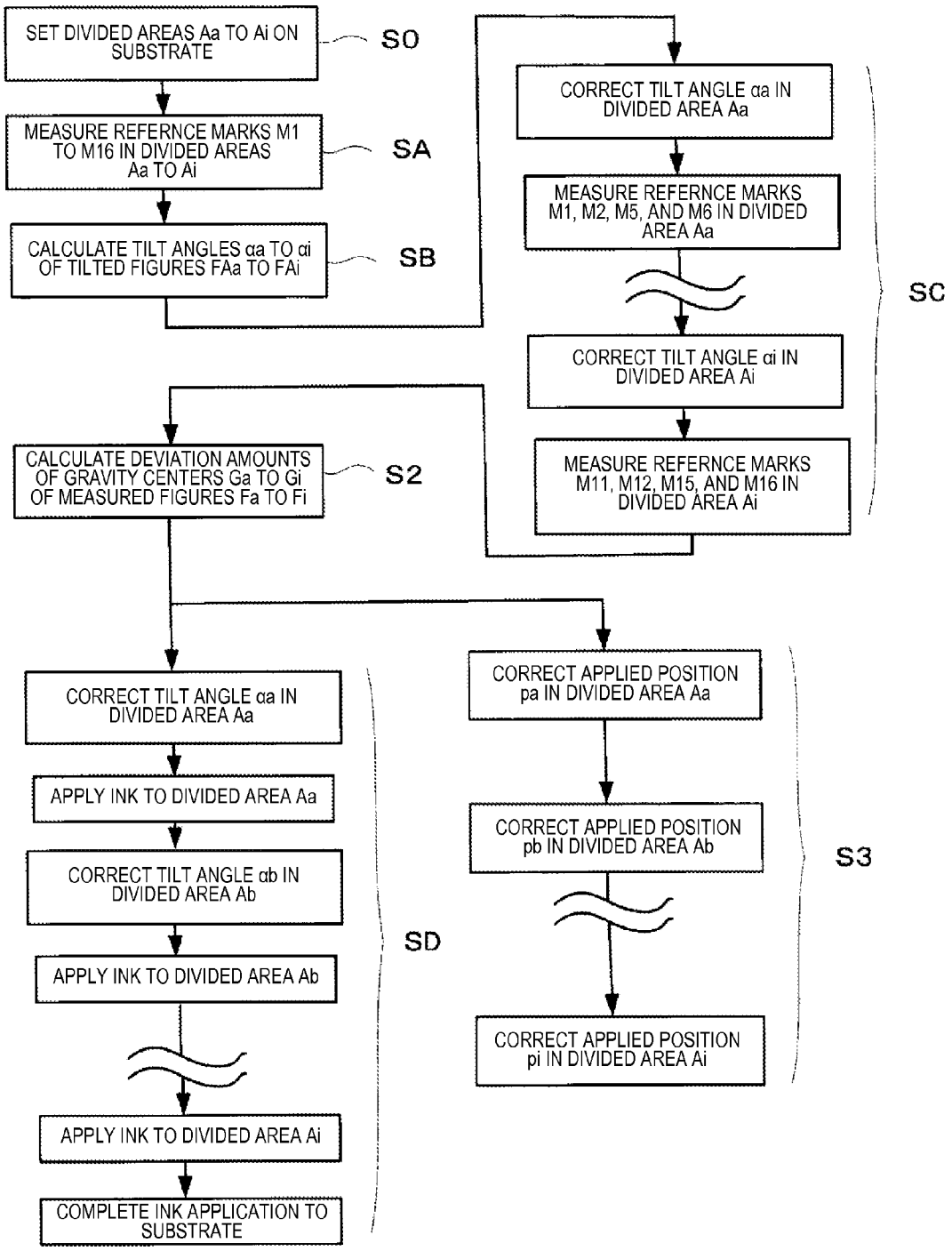
FIG. 7 illustrates a series of steps in a method of ink application on a substrate according to a second exemplary embodiment.

As illustrated in FIG. 7, a method of ink application on a substrate according to the second embodiment includes a divided-area setting step S0, a first reference-mark measuring step SA, a tilt-angle acquisition step SB, a second reference-mark measuring step SC, a gravity-center deviation-amount acquisition step S2, an applied-position acquisition step S3, and an ink application step SD. The first reference-mark measuring step SA and the tilt-angle acquisition step SB are performed to grasp the tilt of a figure in each divided area A.

Figure 8A:
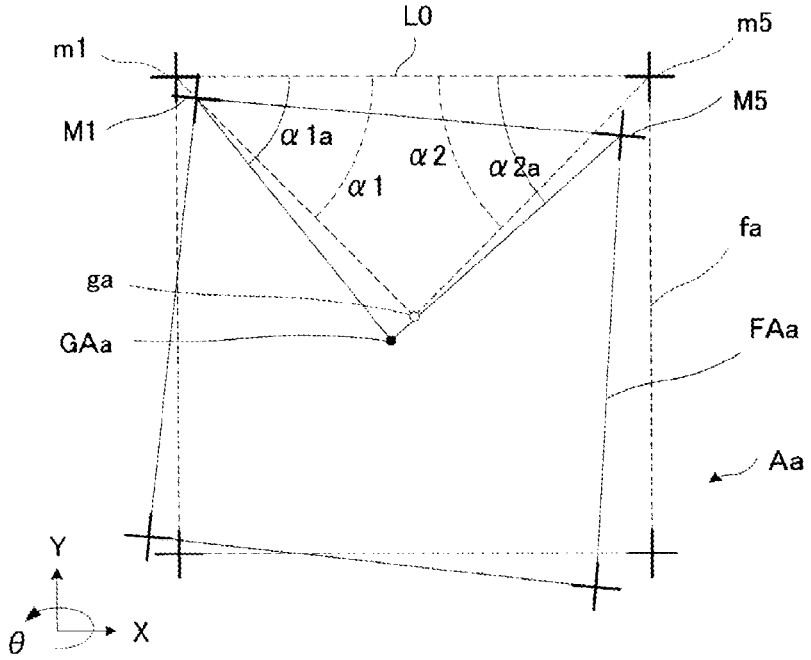
FIGS. 8A and 8B illustrate a divided area on the substrate.
Figure 8B:
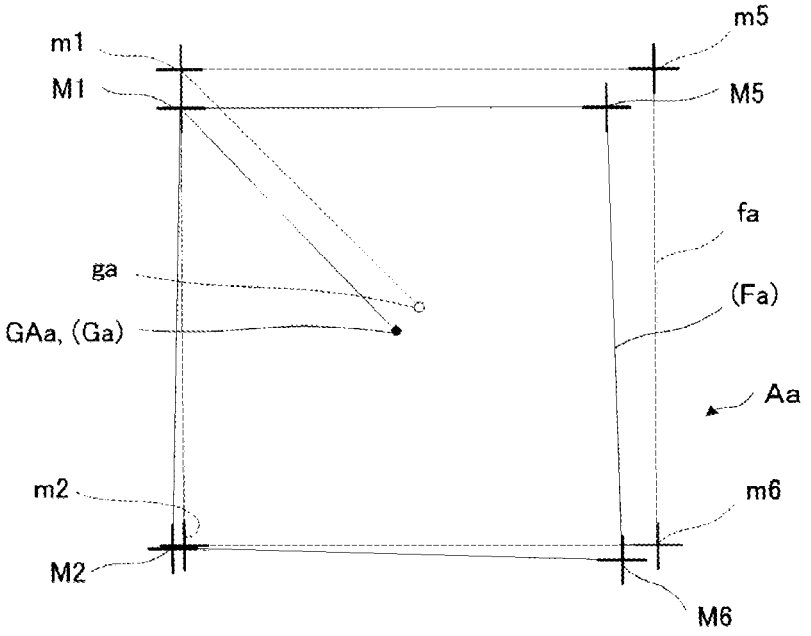

A method for correcting the tilt of the figure will be described below with reference to FIGS. 7, 8A, and 8B. FIGS. 8A and 8B also illustrate the divided area Aa illustrated in FIG. 3A.

In the divided-area setting step S0, a substrate 3 is virtually divided to set a plurality of divided areas Aa to Ai on the substrate 3, similarly to the first embodiment.

In the first reference-mark measuring step SA, a plurality of reference marks M1 to M16 in the divided areas A are measured. To distinguish from a below-described mark measuring step, this reference-mark measuring step is referred to as the first reference-mark measuring step SA, and the later reference-mark measuring step is referred to as the second reference-mark measuring step SC.

In the tilt-angle acquisition step SB, a tilt angle α of a tilted figure FA is found in each of the divided areas A. Here, a tilted figure FA refers to a figure that is tilted in the θ-direction relative to the measured figure F of FIG. 5A. The tilted figure FA is defined by the positions of the reference marks M obtained in the first reference-mark measuring step SA. More specifically, as illustrated in FIG. 8A, a tilted figure FAa is a substantially quadrangular figure whose vertexes corresponds to the reference marks M1, M2, M5, and M6 obtained in the first reference-mark measuring step SA.

The tilt angle α is an angle defined by straight lines connecting the reference marks M obtained in the first reference-mark measuring step SA and the gravity center of the tilted figure FA, and a predetermined reference line. A specific method for finding the tilt angle α will be described with reference to FIG. 8A. First, an angle α1*a* between a straight line connecting the reference mark M1 and a gravity center GAa of the tilted figure FAa, and a designed reference line L0 is obtained by coordinate operation. Similarly, an angle α2*a* between a straight line connecting the reference mark M5 and the gravity center GAa, and the reference line L0 is obtained. In contrast, an angle α1 between a straight line connecting a reference mark m1 and a gravity center ga of a designed figure fa, and the reference line L0 is obtained by coordinate operation. Similarly, an angle α2 between a straight line connecting a reference mark m5 and the gravity center ga, and the reference line L0 is obtained.

Then, angle differences are found at positions corresponding to the reference marks M1 and M5, and an average value of the angle differences is calculated according to Expression (2) to obtain an average value, which serves as a tilt angle αa in the divided area Aa:

$$\alpha a=\{(\alpha 1a-\alpha 1)+(\alpha 2a-\alpha 2)\}/2 \quad (2).$$

In the other divided areas Ab to Ai, gravity centers GAb to GAi of tilted figures FAb to FAi are similarly obtained, and tilt angles αb to αi are obtained.

In the second reference-mark measuring step SC, in each of the divided areas A, the tilt is corrected by rotating the tilted figure FA in the θ-direction, and the reference marks M are then measured. The rotation angle is the tilt angle α obtained in the tilt-angle acquisition step SB. The rotation in the θ-direction is performed by driving a table rotation mechanism 48.

More specifically, as illustrated in FIGS. 7 and 8B, in the divided area Aa, the tilted figure FAa is rotated by the tilt angle αa to correct the tilt, and the reference marks M1, M2, M5, and M6 are then measured. In the other divided areas Ab to Ai, similarly, the tilted figures FAb to FAi are rotated by the obtained tilt angles αb to αi, and the reference marks M are then measured.

In the gravity-center deviation-amount acquisition step S2, similarly to the first embodiment, in each of the divided areas Aa, the deviation amount between the gravity center G of the measured figure F and the gravity center g of the designed figure f is found on the basis of information obtained in the second reference-mark measuring step SC.

In the applied-position acquisition step S3, similarly to the first embodiment, in each of the divided area A, a corrected applied position P is found on the basis of the deviation amount between the measured figure F and the designed figure f.

In the ink application step SD, in each of the divided areas A, the ink 8 is applied after the tilted figure FA is rotated in the θ-direction to correct the tilt. The rotation angle is the tilt angle α obtained in the tilt-angle acquisition step SB. The rotation in the θ-direction is performed by driving the table rotation mechanism 48.

More specifically, as illustrated in FIG. 7, after the tilted figure FAa is rotated by the tilt angle αa in the divided area Aa, ink 8 is applied onto the substrate 3 on the basis of a corrected applied position Pa obtained in the applied-position acquisition step S3. In the other divided areas Ab to Ai, ink 8 is similarly applied on the basis of corrected applied positions Pb to Pi.

To shorten the dry time of the ink 8 landing on the substrate 3, the first reference-mark measuring step SA, the second reference-mark measuring step SC, and the ink application step SD are performed in a state in which the substrate 3 is heated to a predetermined temperature higher than or equal to the room temperature.

The above-described embodiments do not limit the present disclosure, and various modifications can be made as long as consistency can be achieved in the technical idea.

Figure 9:
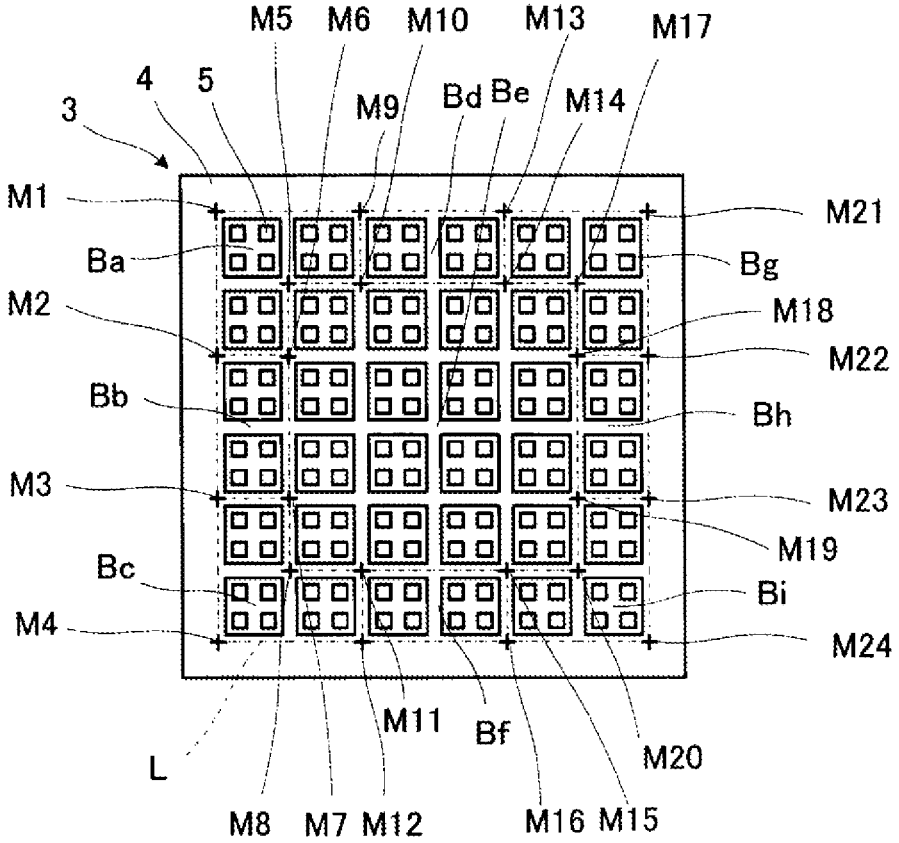
FIG. 9 illustrates modifications of the divided area of the substrate illustrated in FIGS. 3A and 3B.
Figure 10:
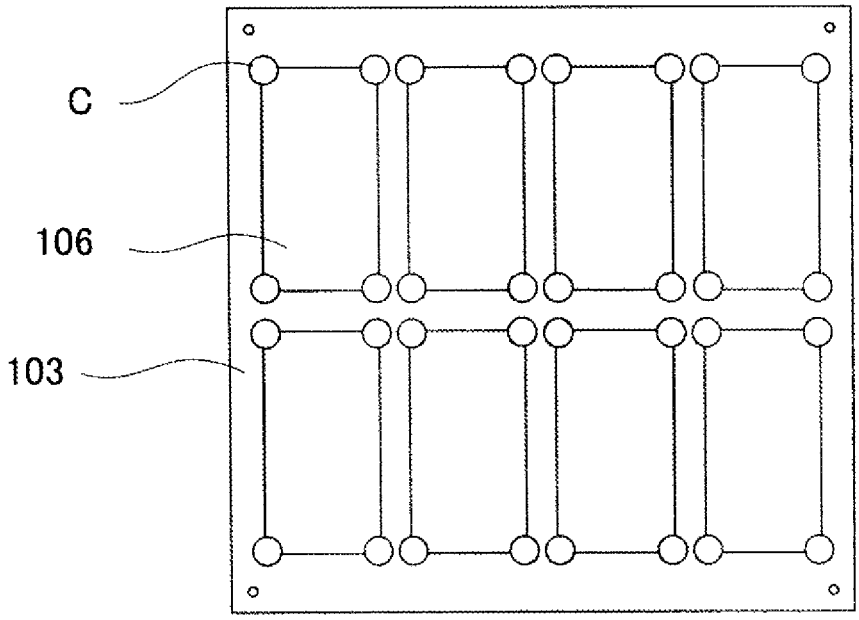
FIG.10 Prior Art
FIG. 10 illustrates a substrate used in an applied-position correcting method of the related art.

For example, as illustrated in FIG. 9, divided areas Ba to Bi may have different shapes and sizes. The number of reference marks M in each of the divided areas Ba to Bi is not limited to four. Even when the number of reference marks M is six or twelve, the gravity center of the measured figure F, the change ratio R, the tilt angle α, etc. can be obtained and the applied position can be corrected by using the reference marks M.

Instead of being obtained using the gravity center G, for example, the change ratio R may be obtained by comparing the area of the measured figure F and the area of the designed figure f, or by comparing the average value of the distances between the adjacent reference marks M in the measured figure F and the average value of the distances between the adjacent reference marks m in the designed figure f.

In embodiments according to the method of ink application on the substrate of the first preferred embodiment, since the applied position is corrected on the basis of the gravity center of the figure defined by the reference marks, even when the divided areas of the substrate are greatly deformed, correction can be made in accordance with average deformation of the divided areas. This allows ink to be applied to a position adequate for a deformation state of the substrate.

In embodiments according to the method of ink application on the substrate of the first preferred embodiment in which the applied-position acquisition step further obtains a change ratio of the measured figure and the designed figure by comparing the measured figure and the designed figure, and shifts and corrects the designed applied position on the basis of the change ratio, since the applied position is corrected on the basis of the change ratio of the figures, it can be corrected with the scale of the designed figure coinciding with the scale of the measured figure. This can further increase the positional accuracy of the applied position.

In embodiments according to the method of ink application on the substrate of the first preferred embodiment in which the applied-position acquisition step obtains the change ratio by comparing distances from the plurality of reference marks obtained in the reference-mark measuring step to the gravity center of the measured figure and distances from the plurality of designed reference marks to the gravity center of the designed figure, since the change ratio is found from the distances between the gravity centers of the figures and the reference marks, the applied position can be corrected according to various designed figures.

In embodiments according to the method of ink application on the substrate of the first preferred embodiment in which the reference-mark measuring step and the ink application step are performed in a state in which the substrate is heated to the same temperature, it is possible to shorten the dry time of ink landing on the substrate and to correct the applied position in consideration of the influence of thermal expansion of the substrate.

In embodiments according to the method of ink application on the substrate of the second preferred embodiment, since the applied position is corrected on the basis of the gravity center of the figure defined by the reference marks, even when the divided areas of the substrate are greatly deformed, the applied position can be corrected according to average deformation of the divided areas. Further, since the applied position is corrected after the tilt of the figure is corrected, ink can be applied to a more adequate position.

In embodiments according to the method of ink application on the substrate of the second preferred embodiment in which the applied-position acquisition step further obtains a change ratio of the measured figure and the designed figure by comparing the measured figure and the designed figure, and shifts and corrects the designed applied position on the basis of the change ratio, since the applied position is corrected on the basis of the change ratio of the figures, it can be corrected with the scale of the designed figure coinciding with the scale of the measured figure. This can further increase the positional accuracy of the applied position.

In embodiments according to the method of ink application on the substrate of the second preferred embodiment in which the applied-position acquisition step obtains the change ratio by comparing distances from the plurality of reference marks obtained in the second reference-mark measuring step to the gravity center of the measured figure and distances from the plurality of designed reference marks to the gravity center of the designed figure, since the change ratio is found from the distances between the gravity center of the figure and the reference marks, the applied position can be corrected according to various designed figures.

In embodiments according to the method of ink application on the substrate of the second preferred embodiment in which the first reference-mark measuring step, the second reference-mark measuring step, and the ink application step are performed in a state in which the substrate is heated to the same temperature, it is possible to shorten the dry time of ink landing on the substrate and to correct the applied position in consideration of the influence of thermal expansion of the substrate.

According to the method of ink application on the substrate of the first preferred embodiment, since the applied position is corrected on the basis of the gravity center of the figure defined by the reference marks, even when the divided areas of the substrate are greatly deformed, correction can be made in accordance with average deformation of the divided areas. This allows ink to be applied to an adequate position for the deformation state of the substrate.

According to the method of ink application on the substrate of the second preferred embodiment, in addition to the advantages obtained by the first preferred embodiment, since the applied position is corrected after the tilt of the figure is corrected, ink can be applied to an adequate position for the deformation state due to the tilt of the figure.

While exemplary embodiments of the disclosure have been described above, it is to be understood that variations and modifications will be apparent to those skilled in the art.

That which is claimed is:

1. A method of ink application on a substrate having a plurality of reference marks, comprising:

a reference-mark measuring step of setting a plurality of divided areas on the substrate by virtually dividing the substrate along a plurality of virtual lines connecting the plurality of reference marks and measuring positions of the plurality of reference marks in each of the divided areas, the divided areas being continuous;

a gravity-center deviation-amount acquisition step of acquiring a deviation amount between a gravity center of a measured figure defined by the positions of the plurality of reference marks obtained in the reference-mark measuring step and a gravity center of a designed figure defined by positions of a plurality of designed reference marks by comparing the gravity center of the measured figure and the gravity center of the designed figure;

an applied-position acquisition step of acquiring a corrected applied position by shifting and correcting a designed applied position on the basis of the deviation amount between the gravity centers; and an ink application step of applying ink onto the substrate by an on-demand printing method according to the corrected applied position.

2. The method of ink application on the substrate according to claim 1, wherein the applied-position acquisition step further obtains a change ratio of the measured figure and the designed figure by comparing the measured figure and the designed figure, and shifts and corrects the designed applied position on the basis of the change ratio.

3. The method of ink application on the substrate according to claim 2, wherein the applied-position acquisition step obtains the change ratio by comparing distances from the plurality of reference marks obtained in the reference-mark measuring step to the gravity center of the measured figure and distances from the plurality of designed reference marks to the gravity center of the designed figure.

4. The method of ink application on the substrate according to claim 1, wherein the reference-mark measuring step and the ink application step are performed in a state in which the substrate is heated to the same temperature.

5. A method of ink application on a substrate having a plurality of reference marks, comprising:

a first reference-mark measuring step of setting a plurality of divided areas on the substrate by virtually dividing the substrate along a plurality of virtual lines connecting the plurality of reference marks and measuring positions of the plurality of reference marks in each of the divided areas, the divided areas being continuous;

a tilt-angle acquisition step of acquiring a tilt angle of a tilted figure defined by the positions of the plurality of reference marks obtained in the first reference-mark measuring step by comparing the tilted figure and a designed figure defined by positions of a plurality of designed reference marks;

a second reference-mark measuring step of measuring the positions of the plurality of reference marks after correcting a tilt of the tilted figure on the basis of the tilt angle;

a gravity-center deviation-amount acquisition step of acquiring a deviation amount between a gravity center of a measured figure defined by the positions of the plurality of reference marks obtained in the second reference-mark measuring step and a gravity center of the designed figure by comparing the gravity center of the measured figure and the gravity center of the designed figure;

an applied-position acquisition step of acquiring a corrected applied position by shifting and correcting a designed applied position on the basis of the deviation amount between the gravity centers; and an ink application step of applying ink onto the substrate by an on-demand printing method according to the corrected applied position after the tilt of the tilted figure is corrected on the basis of the tilt angle.

6. The method of ink application on the substrate according to claim 5, wherein the applied-position acquisition step further obtains a change ratio of the measured figure and the designed figure by comparing the measured figure and the designed figure, and shifts and corrects the designed applied position on the basis of the change ratio.

7. The method of ink application on the substrate according to claim 6, wherein the applied-position acquisition step obtains the change ratio by comparing distances from the plurality of reference marks obtained in the second reference-mark measuring step to the gravity center of the measured figure and distances from the plurality of designed reference marks to the gravity center of the designed figure.

8. The method of ink application on the substrate according to claim 5, wherein the first reference-mark measuring step, the second reference-mark measuring step, and the ink application step are performed in a state in which the substrate is heated to the same temperature.

* * * * *